US005282488A

United States Patent [19]

Roth et al.

[11] Patent Number: 5,282,488

[45] Date of Patent: Feb. 1, 1994

[54] INTERCHANGEABLE FLUID PATH MODULE

[75] Inventors: Stan R. Roth; Thaddeus E. Mazur, both of Rochester; Kenneth E. Waller, Webster, all of N.Y.

[73] Assignee: Eastman Kodak Company

[21] Appl. No.: 793,744

[22] Filed: Nov. 18, 1991

[51] Int. Cl.[5] ..... F17D 1/00

[52] U.S. Cl. ..... 137/15; 137/271; 137/561 A

[58] Field of Search ..... 137/269, 271, 561 A, 137/884, 15

[56] References Cited

U.S. PATENT DOCUMENTS

| | | | |
|---|---|---|---|
| 2,994,339 | 8/1961 | Massey | 137/343 |
| 3,360,008 | 12/1967 | Papale et al. | 137/594 |
| 3,391,703 | 7/1968 | Kay et al. | 137/269 |
| 3,469,863 | 9/1969 | Riester et al. | 285/137 |
| 3,523,547 | 8/1970 | Hatch | 137/269 |
| 3,561,469 | 2/1971 | Kellstrom | 137/343 |
| 3,670,764 | 6/1972 | Tindal | 137/357 |
| 3,680,589 | 8/1972 | Jeans et al. | 137/884 |
| 3,756,274 | 9/1973 | Wolfgramm | 137/561 |
| 3,817,269 | 6/1974 | Raymond | 137/269 |
| 3,934,605 | 1/1976 | Legris | 137/271 |
| 4,032,821 | 6/1977 | Kieser | 361/334 |
| 4,091,840 | 5/1978 | Grove et al. | 137/561 |
| 4,136,713 | 1/1979 | Humphreys | 137/561 |
| 4,183,373 | 1/1980 | Kay | 137/884 X |
| 4,352,532 | 10/1982 | Hardin | 137/269 X |
| 4,458,841 | 7/1984 | Laakaniemi et al. | 236/49 |
| 4,951,709 | 8/1990 | Kirkham | 137/561 |

FOREIGN PATENT DOCUMENTS 1566599 5/1980 United Kingdom .

*Primary Examiner*—John Rivell
*Attorney, Agent, or Firm*—Foley & Lardner

[57] ABSTRACT

A reliable and simple apparatus is provided for connecting interchangeably on the flow path of fluids from a plurality of fluid inlet pipes to a plurality of fluid outlet pipes between multiple systems of flow paths without the provision of any valves or any other moving parts. This apparatus can be configured to be prefabricated to provide the desired flow path selection, and can be manually installed in a minimum period of time with very little skill. Selection of another desired combination of flow paths can be achieved by replacing the apparatus with another apparatus suitably assembled to provide a different combination of flow paths.

10 Claims, 4 Drawing Sheets

INTERCHANGEABLE FLUID PATH MODULE

BACKGROUND OF THE INVENTION

1. Field of the Invention

This invention relates to a fluid flow routing device and method for its use and, more particularly, relates to a device for combining, splitting, and otherwise conveying liquid streams of photosensitizing solution to designated pipelines through designated systems flow paths.

2. Description of Related Art

In the manufacture of photographic products, it is often necessary to combine multiple streams of fluids and to split other streams of fluid to produce streams of fluids having the desired characteristics. This is especially true in applications in which the fluids are applied in a multiple layer coating process. Traditionally, one of two methods has been used to select a designated combination of flow paths.

The first method employs a system of multi-port valves connecting a plurality of inlet pipes to one another and to a plurality of outlet pipes. The valves are actuated either electrically or manually to provide the switching operation required to produce the designated combination of flow paths. While this method provides acceptable flow path selection where only a few lines are involved, the large number of valves required for applications requiring more than a few lines takes up a great deal of space and is undesirably heavy. Moreover, assembly of these complicated systems is difficult and expensive, decreasing the versatility of the system. In addition, since automatically controlled switching systems are extremely complicated and thus fail often, and since there is a high rate of occurrence of human error in manually controlled systems, these systems must be shut down relatively often to identify and solve the problem. While this is not desirable in any application because it wastes fluids and increases operating costs, it is especially troublesome in applications in which materials must be stored while the problem is being identified and solved, since the photographic properties of these materials may change unacceptably during such storage.

The second method of fluid path selection employs a plurality of large two-dimensional panels having fixed optional connections between valve fittings and a number of hose connections, typically six, which must be manually disconnected from one another and reconnected in new ways with each change of product type being manufactured to produce the desired combination of flow paths. These connections are made one at a time according to a previous plan without physical guidance or assurance that the mechanical connections are correct. One such panel is sold under the name Flo-vertor, and is manufactured by TCI-Superior, a Mueller Company.

While these panels provide acceptable flow path selection, they exhibit several disadvantages. First, they are very large and thus require a great deal of operating space. Second, since hydraulic hoses must be manually matched to appropriate locations in the panel, the selection operation requires a great deal of time of a skilled operator. This decreases the efficiency and increases the operating expenses of the device. Third, since the connection and disconnection operations are quite complicated, the chances of human error are relatively high. While the chances of such error can be reduced through the provision of proximity switches on the panel, such proximity switches increase the complexity and operating costs of the device.

There has thus been a need for the provision of a device for selecting the flow paths of photosensitive fluid streams which is sanitary, reliable, compact, and simple to produce and operate. There has also been a need for the provision of a device for selectively switching the flow paths of a system of fluid flow paths in a simple and reliable manner, and to provide a process for simply and reliably selecting a combination of fluid flow paths from a plurality of combinations of flow paths. It would therefore be highly desirable to provide a simple flow path selection device which has no moving parts, which can be installed or changed by an unskilled operator in a short period of time, and which can operate unattended and reliably for as long as necessary.

SUMMARY OF THE INVENTION

These needs have been satisfied by providing an apparatus for routing the flow path of photosensitizing fluids which comprises a portable frame, a plurality of fluid inlet conduits disposed within the frame, and a plurality of fluid outlet conduits disposed within the frame. The inlet conduits and the outlet conduits are interchangeably connected to one another according to pre-designated arrangements to provide a sanitary, valve-free system of flow path selection within the frame for inlet pipes to a plurality of destinations external to the frame via outlet pipes.

In order to simplify connection and disconnection, fittings may be provided for selectively connecting a standard array of inlet conduits to a similar standard array of inlet pipes and for connecting a different but also standard array of outlet conduits to a similar standard and matching array of outlet pipes. Each of these fittings can be assembled by hand without the aid of any tools to provide a sanitary, fluid-tight connection between the respective conduit and the respective pipe.

To provide portability and rigidity, the frame preferably includes a bottom, first and second sides connected to the bottom, and a third side connected to the first and second sides, wherein holes are formed in at least two of the first, second, and third sides and bottom for the passage of the inlet and outlet conduits.

There is also provided a method of selectively changing between combinations of flow paths in a system including a plurality of inlet pipes and a plurality of outlet pipes conveying fluids. The method comprises the steps of disconnecting a first interchangeable apparatus from the inlet and outlet pipes, the first apparatus having a portable frame having a plurality of inlet and outlet conduits extending therefrom and connected to the inlet and outlet pipes, respectively, and the inlet and outlet conduits being connected to one another in a first designated order to form a first designated combination of flow paths. This disconnecting step includes the steps of disconnecting the inlet and outlet pipes from the inlet and outlet conduits and removing the first apparatus from the system. A subsequent step includes inserting a second interchangeable apparatus in the system, the second apparatus comprising a portable frame and a plurality of inlet and outlet conduits extending therefrom and connectable to the inlet and outlet pipes, respectively, and the inlet and outlet conduits being connected to one another in a second designated order to form a second designated combination of flow paths different from the first designated combination of flow paths. The process is completed by connecting the inlet and outlet pipes to the inlet and outlet conduits of the second apparatus.

BRIEF DESCRIPTION OF THE DRAWINGS

The construction and operation of the invention will become more readily apparent as the invention is more clearly understood from the detailed description to follow, reference being had to the accompanying drawings in which like reference numerals represent like parts throughout, and in which.

DETAILED DESCRIPTION OF THE PREFERRED EMBODIMENTS

It has now been discovered that a reliable and simple apparatus can be provided for switching the flow paths of fluids from a plurality of fluid inlet pipes to a plurality of fluid outlet pipes between multiple combinations of flow paths without the provision of any valves or any other moving parts. This apparatus can be programmed or prefabricated to provide the desired flow path selection, and can be manually installed in a minimum period of time with very little skill. Selection of another desired combination of flow paths can be achieved by replacing the selection apparatus with a similar selection apparatus designed to provide a different combination of flow paths.

Figure 1:
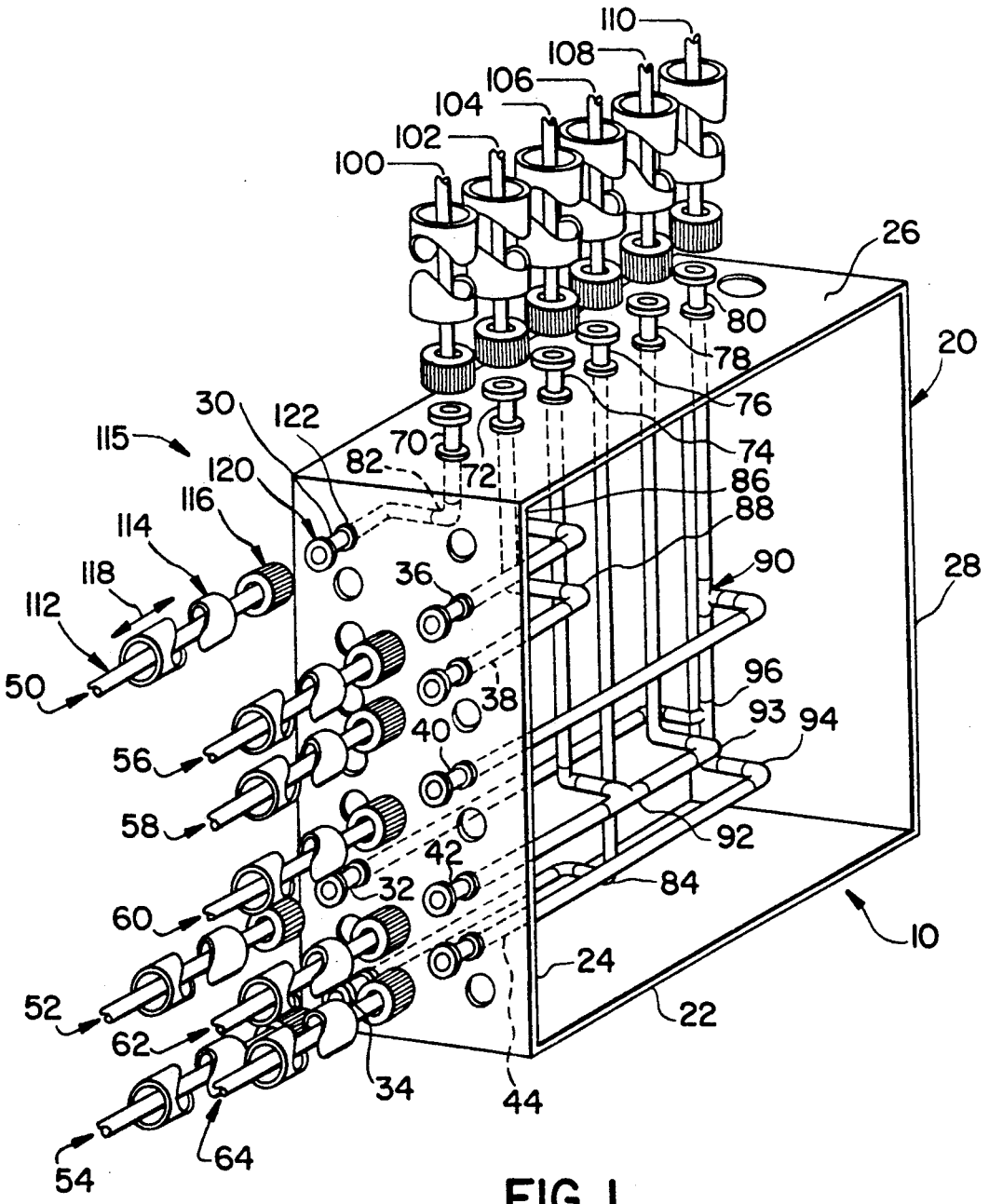
FIG. 1 is a perspective view of an interchangeable flow path module constructed in accordance with a first embodiment of the invention.

Referring to FIG. 1, the apparatus is shown in the form of an interchangeable fluid path module 10 comprising a portable conduit box or frame 20 which is connectable to inlet and outlet pipes. Although other sizes are possible, preferably the conduit box 20 weighs about 30 lbs and thus may be carried and placed into position by one person; hence, conduit box 20 is portable.

A plurality of fluid inlet conduits 30, 32, 34, 36, 38, 40, 42, and 44 and a plurality of fluid outlet conduits 70, 72, 74, 76, 78, and 80 are disposed in conduit box 20 and extend from respective inlets and outlets of the conduit box. The inlet and outlet conduits are connected to one another via connecting elements 82, 84, 86, 88, 90, 92, 93, 94, and 96 which determine the paths of fluids flowing through the conduit box.

The inlet conduits are connectable to respective fixed fluid flow inlet pipes 50, 52, 54, 56, 58, 60, 62, and 64 via respective fittings, and the outlet conduits are connectable to fixed fluid flow outlet pipes 100, 102, 104, 106, 108, 110 Via respective fittings. These outlet pipes are connected at their opposite ends to coating apparatus of a photo-processing device to provide a desired product coating comprising a designated number of layers of specified photosensitizing liquids.

The portable conduit box 20 includes a relatively flat bottom 22 and sides 24, 26, and 28 forming the narrow faces of the box. Holes are formed in the sides of the frame for the passage of the fluid inlet and outlet conduits and are arranged in a convenient fixed pattern which matches the pattern of the fixed inlet and outlet pipes and thus allows easy and unambiguous connection. By providing the external fittings on the narrow faces of the box 20 in this manner, the box allows for the bend radii limitations of the conduits within the box and allows easy access to the internal components of the box from the open end faces. Preferably, the frame is sufficiently rigid to assure dimensional alignment during transport and use, and is constructed of corrosion-resistant materials which can withstand occasional contact with the photosensitizing solutions flowing through the conduits, which solutions typically include chloride and halide solutions. To this end the frame is preferably constructed of a corrosion-resistant metal such as stainless steel, titanium, magnesium, or aluminum or alloys of these metals.

The fittings connecting the fluid inlet or outlet conduits to the associated fluid inlet or outlet pipes are designed to allow for quick and easy connection of the pipes to the conduits by hand without the use of a tool. These fittings are also flexible and thus do not require alteration of equipment upstream or downstream of the conduit box and can accommodate casual misalignments between the conduits of the conduit box and the inlet and outlet pipes. The fittings are lightweight and resistant to corrosion from the chemicals flowing through the fittings. The fittings are also sanitary to the extent that they are fluid-tight and have no crevices in which impurities can be trapped.

Preferably, each of the inlet and outlet pipes comprises a flexible tube 112 which is protected by a sleeve 114 and which can be shifted back and forth in the direction of arrow 118 to allow connection of the pipe to the respective inlet or outlet conduit. The flexible tube terminates in a fitting 115 including an internally threaded female coupling 116 having ridges formed on its outer surface to facilitate manual gripping of the coupling. The coupling 116 of each inlet or outlet pipe mates with an externally threaded male coupling 120 formed on the end of the respective inlet or outlet conduit. A gasket 122 is provided at the point where each inlet and outlet conduit passes through conduit box 20 to hold each conduit in place. Alternatively, a fitting may be mounted directly on the conduit box without a gasket, and the inlet or outlet conduit may be connected to the fitting. The fittings are capable of withstanding the temperatures and pressures of the fluids flowing through the fittings and also resist corrosion by these fluids. To this end, the frame, fittings, connecting elements, tubes, and conduits may be made of some combination of stainless steel, titanium, Kynar or polyvinylidene difluoride (PVDF), Teflon or polytetrafluoroethylene (PTFE), a plastic such as polypropylene, ethylene propylene diene monomer (EPDM), or ethylene propylene rubber (EPR), as well as glass and ceramics. When used for conveying photosensitive solutions, these components must be light blocking.

The inlet conduits and outlet conduits consist of corrosion-resistant piping capable of conveying fluids under relatively high pressure (for example, from about 5 to about 40 psi) at relatively high flow rates (for example, up to 2 gallons per minute per conduit) without rupture or leakage. In the illustrated embodiment, stainless steel pipe is used for the conduits, although other materials could be used. These conduits are connected to one another in the conduit box 20 to provide the routing of incoming fluids to provide the combination of flow paths producing the desired pattern of outgoing fluids. "Routing", within the context of the invention, is to be understood to comprise the splitting, combining, or otherwise conveying of inlet fluids in a designated manner to produce the desired combination of output flow paths. To this end, the inlet and outlet conduits can be connected to one another via elbows, T-elements, and X-elements in any desired manner to connect any combination of inlets to any combination of outlets. Preferably, these elbows, T-elements, and X-elements also are sanitary.

In the embodiment illustrated in FIG. 1, the conduit box 20 is capable of accommodating up to 18 inlet conduits and up to 7 outlet conduits. However, in the illustrated application, the particular use requires only 6 coating fluids producible from a combination of only 8 constituent fluids. Therefore, this particular conduit box is fitted with only 8 inlet conduits and 6 outlet conduits. Other preferred embodiments of the conduit box include one fitted with 18 inlet conduits and 7 outlet conduits, and one fitted with 19 inlet conduits and 13 outlet conduits. These particular numbers are intended to be exemplary only, and any number of inlet and outlet conduits could actually be provided. As the numbers of inlet and outlet conduits increases, the usefulness of the invention in assuring correct connections of all inlets and outlets also increases.

Each of the outlet pipes 100, 104, 106, and 108 receives only a single solution from the associated inlet conduit 30, 42, 34, and 42 via respective elbow and T-connections 82, 92, 84, 93. However, outlet pipe 102 receives solutions from both inlet conduits 36 and 38 by Virtue of the T element 86 and the elbow 88, respectively, and outlet pipe 110 receives solutions from inlet conduits 32, 40, and 44 by virtue of the respective T or elbow connections 90, 94, and 96. The remaining holes in conduit box 20 are not in use, and may be plugged if desired.

The internal conduits and connecting elements of the conduit box 20 can be cleaned on site by disconnecting the conduit box from the inlet and outlet pipes and by flushing a suitable cleaner through the conduits. Alternatively, the conduit box 20 may be cleaned in place by flushing a suitable cleaner through the inlet pipes.

Figure 2:
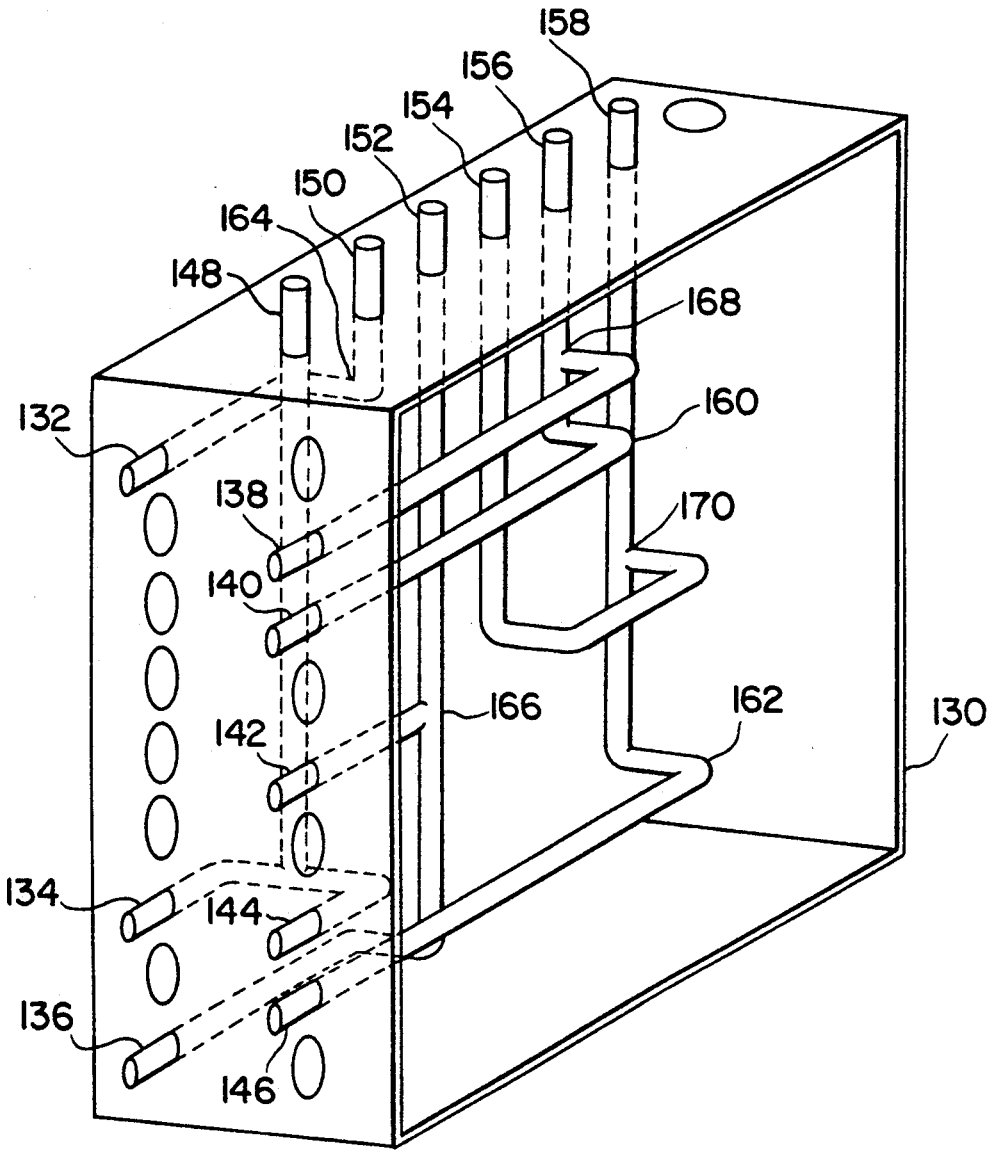
FIG. 2 is a perspective view of an interchangeable flow path module using the same inlet and outlet pipes of FIG. 1 but with a different flow path configuration.

Thus, the illustrated device selects a designated system of input flow paths to produce a specified combination of output flow paths via the lines 100–110 formed from a predetermined routing of the fluids entering the box via inlets 50–64. If it is desired in production to change to a different combination of output flow paths using the same source fluids, the system can be modified to produce this new combination of fluids quickly and easily by disconnecting the conduit box 20 from the inlet and outlet pipes and by replacing the conduit box 20 with another prefabricated conduit box having the same construction as the conduit box of FIG. 1 but having a different network of internal conduits, such as the conduit box 130 of FIG. 2. This conduit box has inlet conduits 132, 134, 136, 138, 140, 142, 144, and 146 and outlet conduits 148, 150, 152, 154, 156, and 158 which are positioned identically to those of the conduit box 20 and which can therefore be connected to the existing inlet and outlet pipes without any modification of the pipes. However, the inlet and outlet conduits are thus connected to one another in a different and reliable manner via a different system of connectors such as elbows 160, 162, and 164 and T-connectors 166, 168, and 170, thereby establishing a different combination of flow paths through the conduit box.

The conduit box weighs about 30 lbs and is thus portable. That is, it can be readily carried by a single person. Since the changeover of flow paths does not require the automatic or manual operation of any internal valves, and does not require a rearrangement of external hoses, it is virtually foolproof and can be completed in a short time by a single unskilled operator. For example, one operator can disconnect an old conduit box and install a new conduit box in about 5–10 minutes. Thus, the device can reliably supply specified liquids in designated output pipes for each unique product requirement. Meanwhile, the unused conduit box 20 can be removed from the production area and stored for re-use should it be desirable to resume production of the first product.

When the first coating product is no longer manufactured, the internal conduits of the conduit box 20 can be removed and replaced with a different arrangement of conduits and connectors providing a different combination of flow paths required for producing a different coating product. This replacement is facilitated by the use of ordinary piping and connectors within the box 20 which are connected via conventional connectors and which thus can be assembled and disassembled with a minimum of difficulty. This assembly and disassembly would not be possible if a machined manifold assembly were to be used to provide the required routing operations.

Figure 3:
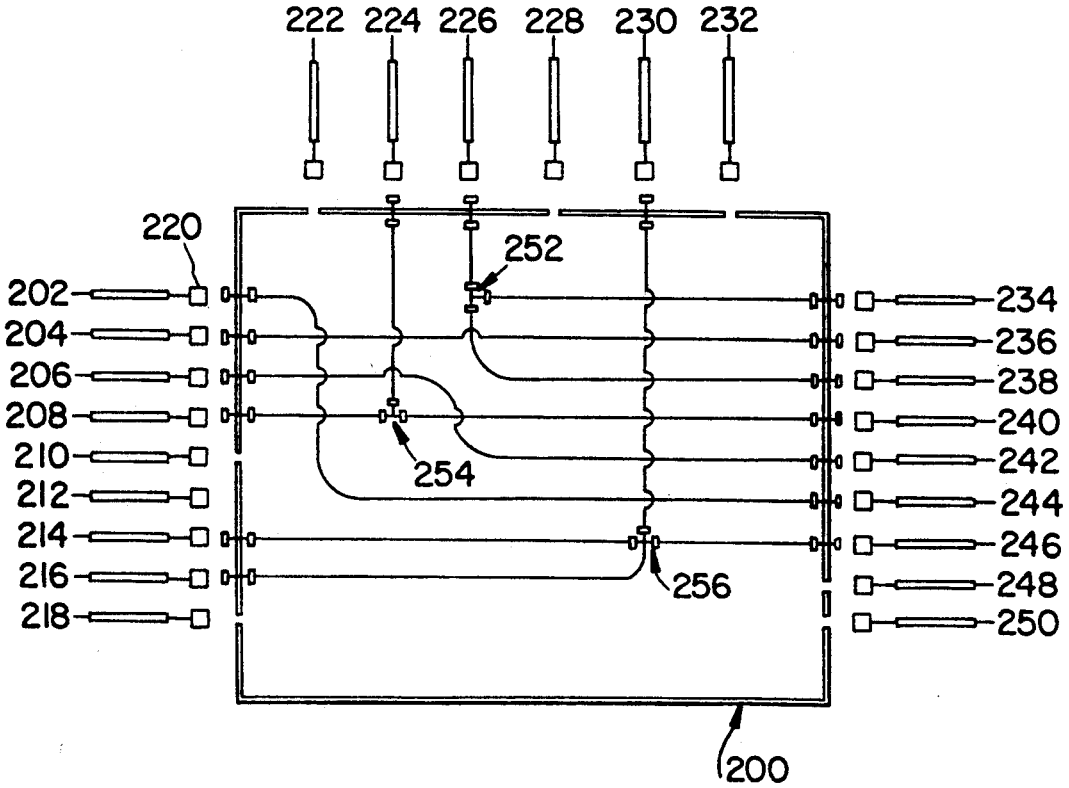
FIG. 3 is a schematic elevational view of an interchangeable flow path module constructed in accordance with a second embodiment of the invention.

Another conduit box or frame 200 constructed in accordance with the invention is illustrated schematically in FIG. 3. This conduit box is formed of the same materials with the same criteria as the conduit box 20 of FIG. 1 and the conduit box 130 of FIG. 2. Conduit box 200 is connectable to a second system of inlet and outlet pipes in Which a specified number of inlet and outlet pipes are present but only some of the pipes are required to produce each particular combination of flow paths. The conduit box 200 can be selectively connected to a first set of inlet pipes 202, 204, 206, 208, 210, 212, 214, 216, and 218 facing a first side of the box, a second set of inlet pipes 222, 224, 226, 228, 230, 232 facing the top side of the box, and a set of outlet pipes 234, 236, 238, 240, 242, 244, 246, 248, and 250 facing a second side of the box. Each of these inlet and outlet pipes is connectable to an associated inlet or outlet conduit of the conduit box 200 via a fitting, such as the connector 220 of inlet pipe 202. Each fitting is preferably identical in construction and operation to those described above in connection with FIGS. 1 and 2. In the particular application illustrated in FIG. 3, inlet pipes 210, 212, 218, 222, 228, and 232 and outlet pipes 248 and 250 are not required to produce the particular combination of outlet flow paths, and thus are not connected to the conduit box and conduct no fluid.

The internal conduits of conduit box 200 are constructed of a flexible material such as a hydraulic line and are connected to one another to produce a designated combination of flow paths, and thus need connectors only at junctions between two or more conduits. In the illustrated example, these connectors include a T-element 252 connecting the conduit or line conveying fluid from the inlet 226 to the conduits or lines conveying fluid to the outlets 234 and 238, a T-element 254 connecting the lines conveying fluid from the inlets 208 and 224 to the line conveying fluid to outlet 240, and an X-element 256 connecting the lines conveying fluid from the inlets 214, 216, and 230 to the line conveying fluid to the outlet 246.

Figure 4:
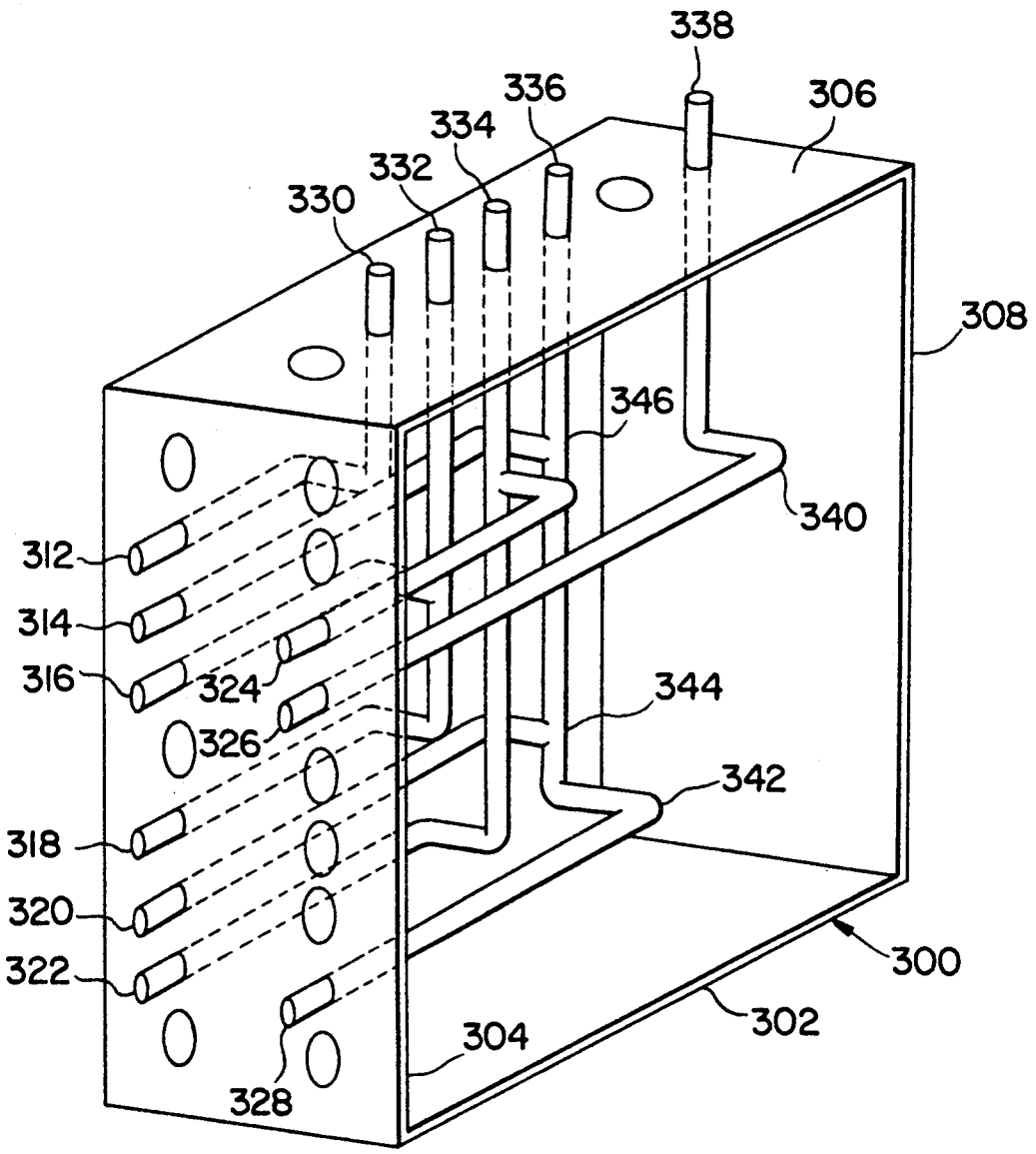
FIG. 4 is a perspective view of an interchangeable flow path module constructed in accordance with a third embodiment of the invention.

Another conduit box or frame 300 constructed in accordance with the invention is illustrated in FIG. 4. Conduit box 300 includes a bottom 302 and sides 304, 306, and 308, and is identical in construction and operation to the conduit box 20 of FIG. 1 and the conduit box 130 of FIG. 2. However, this conduit box employs a different system of 9 inlet conduits and 5 outlet conduits connected to one another in a different manner to provide a different combination of flow paths. Specifically, inlet conduits 312, 314, 316, 318, 320, 322, 324, 326, and 328 are connected to outlet conduits 330, 332, 334, 336, and 338 via elements such as elbows 340 and 342 and T-elements 344 and 346 to provide a designated combination of flow paths which is different from that provided by the systems of FIGS. 1 and 2. Moreover, since the inlet and outlet conduits are provided in different numbers in different locations than those of FIGS. 1 and 2, they are connectable to a uniquely different system of inlet and outlet pipes than that described in connection with the embodiments of FIGS. 1 and 2.

It is to be understood that the foregoing detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A system for selectively changing a selected combination of fluid flow paths for routing fluids to a different combination of flow paths, comprising:

(A) a plurality of inlet pipes and a plurality of outlet pipes; and (B) a plurality of interchangeable apparatuses for establishing a plurality of combinations of flow paths from said inlet pipes to said outlet pipes, each interchangeable apparatus including (i) a frame, (ii) a plurality of fluid inlet conduits disposed within said frame and connectable to said inlet pipes, and (iii) a plurality of fluid outlet conduits disposed within said frame, said outlet conduits being connected to said fluid inlet conduits and being connectable to said outlet pipes to provide a sanitary, valve-free system of flow path selection within said frame for switching a plurality of fluid inlet flow paths to a plurality of outlet flow paths, all of said inlet flow paths and said outlet flow paths being external to said frame, wherein the inlet and outlet conduits of each apparatus are connected to one another to establish a sanitary, valve-free system of flow path selection which is different from that of the other apparatuses.

2. The system of claim 1, further comprising fittings for selectively connecting said inlet pipes of each apparatus to said inlet conduits and for connecting said outlet pipes of each apparatus to said outlet conduits.

3. The system of claim 2, wherein each of said fittings can be assembled by hand without the aid of any tools to provide a sanitary, fluid-tight connection between the respective conduit and the respective pipe.

4. The system of claim 1, wherein said frame, said inlet and outlet conduits, and said fittings of each apparatus are constructed from materials which are resistent to corrosion by said fluids.

5. The system of claim 1, wherein said frame of each apparatus comprises a bottom, first and second sides connected to said bottom, and a third side connected to said first and second sides, and wherein holes are formed in at least two of said first, second, and third sides and said bottom for the passage of said inlet and outlet conduits.

6. The system of claim 1, wherein said frame is portable.

7. A method of changing a selected combination of flow paths in a system for routing fluids including a plurality of inlet pipes and a plurality of outlet pipes, said method comprising the steps of:

(A) disconnecting a first interchangeable apparatus from said inlet and outlet pipes, said first apparatus having a portable frame having a plurality of inlet and outlet conduits extending therefrom and connected to said inlet and outlet pipes, respectively, said inlet and outlet conduits being connected to one another within said frame in a first specified order to form a first designated combination of value-free flow paths, said disconnecting step including the steps of disconnecting said inlet and outlet conduits from said inlet and outlet pipes and removing said first apparatus from said system; then (B) inserting a second interchangeable apparatus in said system, said second apparatus comprising a portable frame and a plurality of inlet and outlet conduits extending therefrom and connectable to said inlet and outlet pipes, respectively, said inlet and outlet conduits being connected to one another within said frame in a second specified order to form a second designated combination of value-free flow paths different said first designated combination of value-free flow paths; and then (C) connecting said inlet and outlet pipes to said inlet and outlet conduits of said second apparatus.

8. The method of claim 7, wherein said step (C) comprises disconnecting and connecting fittings by hand without the aid of any tools to provide a sanitary, fluid-tight connection between each of said conduits and the respective pipe.

9. The method of claim 7, further comprising the step (D) of disconnecting said inlet conduits and said outlet conduits of said first apparatus from one another and connecting said inlet conduits and outlet conduits to one another in a third specified order to form a third designated combination of value-free flow paths different from said first designated combination of flow paths.

10. The method of claim 9, further comprising the steps of (E) disconnecting said second apparatus from said inlet and outlet pipes following said step (C), said disconnecting step (E) including the steps of disconnecting said inlet and outlet pipes from said inlet and outlet conduits and removing said second apparatus from said system, then (F) inserting said first apparatus in said system after said step (D), and then (G) connecting said inlet and outlet pipes to said inlet and outlet conduits of said first apparatus.

* * * * *